US006069998A

United States Patent [19]

Barnes et al.

[11] Patent Number: 6,069,998

[45] Date of Patent: May 30, 2000

[54] INTEGRAL WATER HEATER AND WATER TEMPERATURE SENSOR

[75] Inventors: Ronald R. Barnes, Columbus, Miss.; Robert K. Cockrell, Vernon, Ala.

[73] Assignee: Emerson Electric Company, St. Louis, Mo.

[21] Appl. No.: 09/148,305

[22] Filed: Sep. 4, 1998

[51] Int. Cl.[7] ..... H05B 1/02

[52] U.S. Cl. ..... 392/498; 392/455; 392/500; 219/520

[58] Field of Search ..... 392/497–498, 392/500–1, 449, 451, 454–5

[56] References Cited

U.S. PATENT DOCUMENTS 5,586,214 12/1996 Eckman ..... 392/503

*Primary Examiner*—Teresa Walberg
*Assistant Examiner*—Thor Campbell
*Attorney, Agent, or Firm*—Polster, Lieder, Woodruff & Lucchesi L.C.

[57] ABSTRACT

A screwplug type water heater (10) has a heating element (12) immersible in a water heater tank (T) to heat water (L). Electrical terminals (28) on the outer end of the heater connect the heating element into a heater circuit (H) for a control unit (14). The control unit also includes a sensing circuit (S) for the unit to be responsive to water temperature inputs to turn-on the heater to heat water to a desired temperature and maintain it there. A thermistor (16) provides a temperature input to the control circuit. The thermistor is encapsulated in a bracket (32) mounted in, or integrally formed with, the screwplug to sense water temperature. Terminals (36) on the outer end of the heater allow the thermistor to be connected into the control circuit.

17 Claims, 2 Drawing Sheets

INTEGRAL WATER HEATER AND WATER TEMPERATURE SENSOR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to heater units for hot water heaters such as found in homes, and more particularly, to a water heater assembly with a heater element and temperature sensor installed with the heater unit. In one embodiment, the temperature sensor device is integrally formed with the unit. In another embodiment the sensor can be removed and replaced without having to remove and reinstall the heater unit.

Water heaters have an associated control system by which water temperature is monitored so the water can be heated to a desired temperature as efficiently as possible, and then maintained at that temperature. A thermistor, or other temperature responsive sensing device, is used to provide an input to the control system representative of water temperature. Heretofore, location of the sensing element has been separate from a water heater, and the sensor location has not always been readily accessible so the sensor could be readily replaced. Combining a temperature sensor with a water heater unit therefore has certain advantages of cost, ease of installation, and maintenance or replacement. Further, there are certain advantages in making, the assembly an integral assembly.

BRIEF SUMMARY OF THE INVENTION

Among the several objects of the present invention may be noted the provision of a water heater assembly including a heater element in combination with a temperature sensor such as a thermistor;

- the provision of such an assembly in which the temperature sensor is readily installed with the water heater element as an integral unit;
- the provision of such a temperature sensor to be readily installable and removable from the heater assembly, this being accomplished without the entire heater assembly having to be removed and reinstalled;
- the provision of such an assembly in which the thermistor is formed as a molded part having a snap-fit insertion into a base portion of the assembly, the thermistor further including male quick connect pins for ready connection into temperature sensing circuitry of the control system;
- the provision of such a combination in which the value of the thermistor rating is variable in accordance with the requirements of the electronic control circuitry to which it is attached;
- the provision of such a combination having an increased sensitivity to the water temperature to effect better temperature control;
- the provision of such a combination to employ an off-center heating element mounting configuration so to accommodate the temperature sensor;
- the provision of such a combination in which the sensing device is located at the end of a bracket tongue extending from a connector end of the sensor element into a cavity formed in a screwplug portion of the sensor to position the sensor in, or adjacent to, a threaded portion of the screwplug;
- the provision of such an assembly to reliably provide accurate water temperature measurements to the control system; and,
- the provision of such a combination to be easily installed and removed and to provide a low cost water temperature measurement capability.

In accordance with the invention, generally stated, a water heater is a screwplug type assembly having a heating element immersible in the water in a water tank to heat the water to a desired temperature. Electrical terminals on an outer end of the assembly allow the heating element to be connected into a heater circuit. A control circuit responsive to water temperature controls operation of the heater to heat the water. An input to the control circuit is provided by a thermistor or other temperature sensor installed in an outer end portion of the heater assembly. The thermistor is either integrally formed with the water heater; or, can be a separate element readily inserted into the outer end of the assembly. The thermistor is encapsulated in a support sized to extend from the outer end of the heater into the screwplug portion of the heater, or adjacent thereto, for the thermistor to sense water temperature. Terminals on the outer end of the assembly allow the thermistor to be connected into the control circuit Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
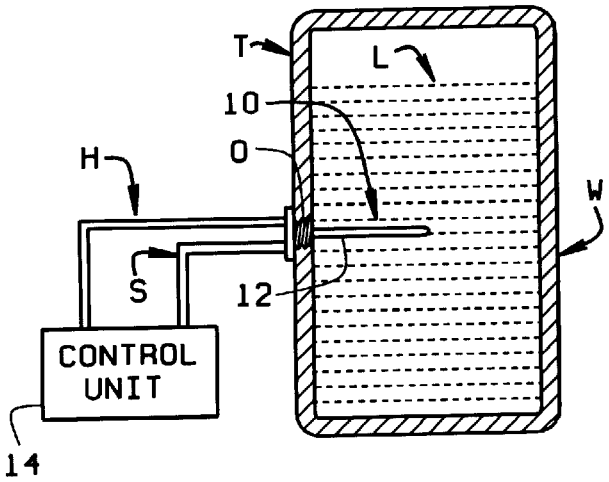
FIG. 1 is a representation of a water tank with a heater assembly of the present invention installed.

Referring to the drawings, a tank T holds a liquid such as water. A threaded opening O is formed in a sidewall W of the tank for installation of an immersion type water heater 10. The heater includes a resistance-type heating element 12 of conventional design electrically connected to a control unit 14. The control unit is responsive, inter alia, to inputs from a temperature sensor 16, such as a thermistor connected in a sensing circuit S of the control unit, to supply electrical power to the heating element via a heater circuit H. The heating element heats water in the tank to a desired temperature (e.g., 140° F.) and maintains the water temperature at that level.

Figure 3:
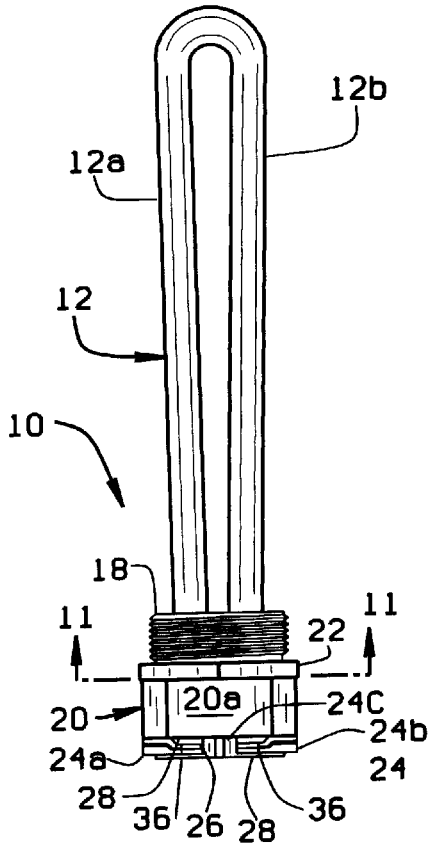
FIG. 3 is a side view of a water heater assembly of the present invention.
Figure 2:
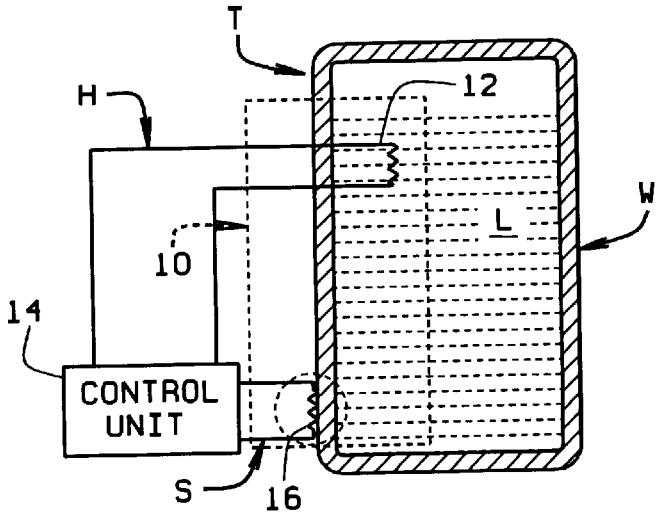
FIG. 2 is a simplified schematic of heater and temperature sensing control circuits.

Referring to FIG. 3, heater 10 comprises three main elements; heating element 12, a mounting means 18 for installing the heater assembly in the tank sidewall, and a housing 20 attached the mounting means and located on the outside of the tank. Mounting means 18, comprises a screwplug having a sidewall matingly threaded with opening O to screw the heater into place. Heater element 12, which is generally U-shaped has legs 12*a*, 12*b* extending into housing 20 through the screwplug. A hexagonal flange 22 formed at the outer end of the screwplug is useful in installing and replacing the heater.

Figure 4:
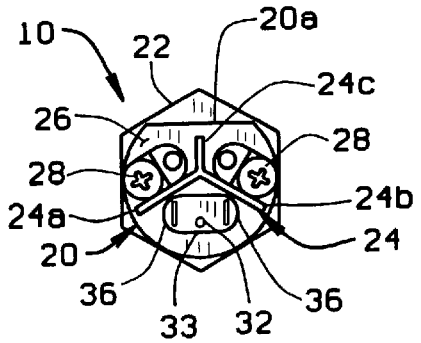
FIG. 4 is an end view thereof.
Figure 11:
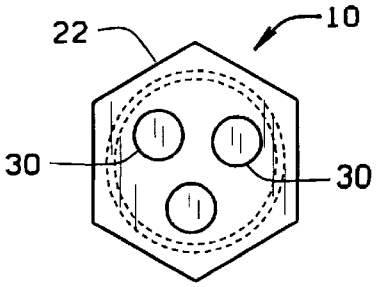
FIG. 11 is an end view of the screwplug portion of the heater assembly; and, FIG. 12 is a partial sectional view of the screwplug.

Housing 20 is a generally circular shaped housing with a truncated or flattened section 20*a* as shown in FIG. 4. The housing includes a Y-shaped divider 24 formed on an outer end face 26 of the housing. The divider has two arms 24*a*, 24*b* of equal length, and a leg 24*c* shorter than the arms. The dividers divide the outer face of housing 20 into three separate segments. Respective segments defined by divider sections 24*a*–24*c*, and 24*b*–24*c*, have electrical terminals 28 for the respective ends of heater element 10 to be connected in the heating circuit of control unit 14. Referring to FIG. 11, it will be seen that the legs of the heater element extend through longitudinal channels 30 in the screwplug. It will further be seen that, unlike convention-cheaters, the channels are offcenter of the screwplug. This is to accommodate installation of temperature sensor 16 in the heater assembly.

Figure 5:
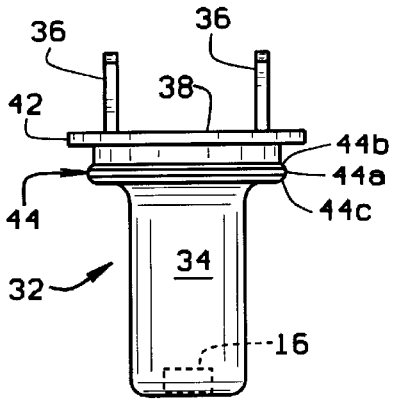
FIGS. 5 and 6 are respective side views of a first embodiment of a thermistor unit installed in the heater element.
Figure 6:
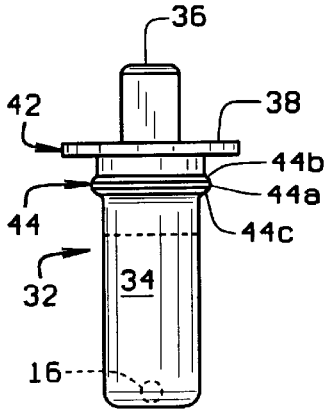
Figure 7:
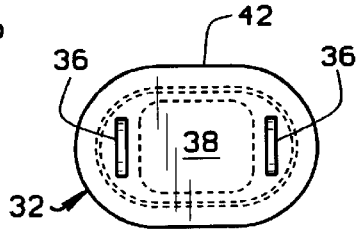
FIG. 7 is an end view of the first embodiment.
Figure 12:
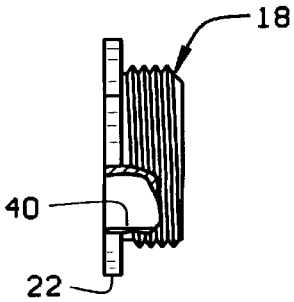

In FIGS. 5–7, a first embodiment of the temperature sensor includes the thermistor 16 encapsulated in a bracket 32. Specifically, the bracket either fits in an oval shaped opening 33 formed in the outer end of the housing; or, the bracket/thermistor assembly is integrally formed with the housing. Regardless, bracket 32 includes a tongue 34. The thermistor is encapsulated at the inner end of the tongue (when the bracket is installed in the housing). Electrical leads for the thermistor are also encapsulated in the tongue and extend through the length of the tongue to electrical terminals 36 which project from an outer end 38 of the bracket These terminals are quick disconnect terminals and allow the thermistor to be connected in sensing circuit S of the control unit. For heater control purposes, it is important that the thermistor be positioned in a temperature sensing relationship with the water. Accordingly, the length of tongue 34 is such that the thermistor is located adjacent the inner end of the screwplug (i.e., at the level of flange 22 when the heater is installed. Or, as shown in FIG. 12, a recess or blind bore 40 extends into the body of the screwplug, from an inner end of the screwplug, with the inner end of tongue 34, fitting in this recess. As noted, bracket 32 is either integrally formed with the housing, or it can, be a separate piece. The bracket 32 of FIGS. 5–7 is for a separate piece. As shown therein, at the outer end of the bracket is an oval shaped flange 42 sized to be fit in opening 33 in the outer end of housing 20. Inwardly of this flange, at the inner end of tongue 34, a circumferential seal 44 is formed. The seal has a central section 44*a*, and upper and lower beveled sections 44*b*, 44*c*. When installed, the thermistor is readily replaced by disconnecting wiring leads from the terminals 36 and pulling the bracket/thermistor assembly out of housing 20. A new assembly is the inserted in opening 33 and the wiring leads reconnected to the terminals of the nests assembly.

Figure 8:
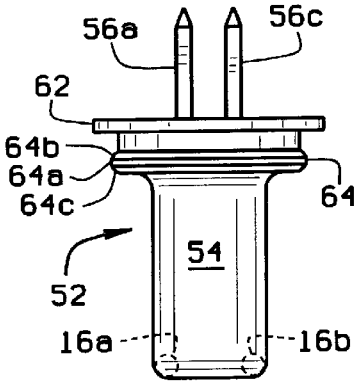
FIGS. 8 and 9 are respective side views of a second embodiment of the thermistor unit.
Figure 9:
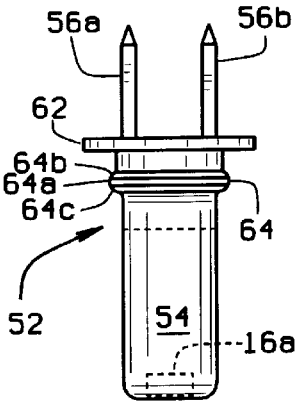
Figure 10:
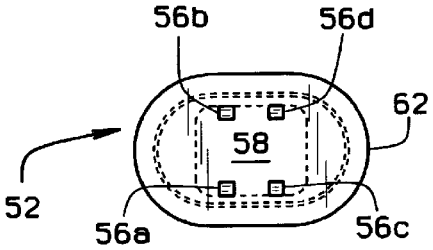
FIG. 10 is an end view of the second embodiment.

Referring to FIGS. 8–10, another embodiment of the bracket is indicated generally 52. Now, two separate thermistors 16*a*, 16*b* are encapsulated in the bracket which, again, either fits in the oval shaped opening 33 in the outer end of housing 20; or is integrally formed with tire housing. Bracket 52 includes a tongue 54 and the thermistors are encapsulated in the inner end of the tongue. Electrical leads for each thermistor are also encapsulated in the tongue and extend through the length of the tongue respective sets of electrical terminals 56*a*, 56*b*, and 56*c*, 56*d* all of project from an outer end 58 of the bracket. Again, the terminals allow the thermistors to be connected in sensing circuit S of control unit 14. Also again, the length of tongue 54 is such that the thermistors are located adjacent the inner end of the screwplug, or in the recess 40 in the body of the screwplug. At the outer end of the bracket is an oval shaped flange 62 sized to fit in opening 33, and inwardly of this flange is a circumferential seal 64 having a central section 64*a*, and upper and lower beveled sections 64*b*, 64*c*. Installation and removal of bracket 52, or the housing/bracket assembly is as above described.

What has been described is a water heater assembly in which a thermistor for sensing water temperature is incorporated. The thermistor is encapsulated at one end of a housing which can be integrally formed with a housing portion of the heater, or which is readily installed and removed from the housing. The thermistor extends either into, or is positioned adjacent the outer end of the screwplug so to be in a heat sensing relationship with the water. The thermistor is electrically connected into the sensing circuit of a control unit which operates the water heater to heat the water to a desired temperature and maintain it there. In a second embodiment of the heater assembly, a pair of thermistors are employed with both thermistors being encapsulated and located in the housing to sense water temperature.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. An immersion heater for heating a liquid in a tank comprising:

mounting means receivable in a sidewall of said tank for attaching said heater in place, said mounting means including a housing on the outside of said tank when the immersion heater is installed in place;

a heating element projecting from said mounting means into said tank to heat the liquid therein;

a temperature sensor installed in said housing in a temperature sensing relationship with the liquid, said temperature sensor sensing temperature of the liquid and providing an indication thereof for control of the immersion heater to heat the liquid to a desired temperature and maintain it at that temperature; and, means positioning said sensor within said housing in a temperature sensing relationship with the liquid, said positioning means including a bracket fitting into an opening in an outer end of said housing, said bracket including an integrally formed tongue extending into said opening for an inner end of said tongue to be positioned adjacent said sidewall of said tank, and said sensor being encapsulated in said tongue at said inner end thereof.

2. The immersion heater of claim 1 wherein the sidewall of said tank has a threaded opening formed therein and said mounting means includes a screwplug threadably received in said opening.

3. The immersion heater of claim 2 wherein said screwplug has an opening formed therein and said sensor is positioned in said opening.

4. The immersion heater of claim 2 wherein said sensor is installed in said housing adjacent said screwplug.

5. The immersion heater of claim 1 wherein said bracket has an outer end sized to fit into said opening in said outer end of said housing for removably installing the bracket.

6. The immersion heater of claim 1 wherein said bracket is integrally formed with a cover for said housing to permanently install said bracket in said mounting means.

7. The immersion heater of claim 1 wherein said temperature sensor comprises a thermistor having electrical leads also encapsulated in said bracket with ends of said leads terminating in electrical connectors extending from said bracket for connecting said thermistor into a control circuit for said immersion heater.

8. The immersion heater of claim 1 wherein said sensor further includes a second thermistor encapsulated in said tongue at the inner end thereof, said second thermistor also having electrical leads encapsulated in said tongue with ends of said leads terminating in electrical connectors extending from said bracket for connecting said second thermistor into said control circuit.

9. A water heater for heating a water in a tank comprising:

a screwplug threadably received in a threaded opening in a sidewall of said tank to mount the heater to the tank;

a heating element extending through said screwplug and into said tank to heat water in the tank;

a housing through which ends of said heater element extend for electrically connecting said heater element into an electrical circuit used for heating the water to a desired temperature and maintaining it at that temperature; and, a temperature sensor installed in said housing for sensing the water temperature and providing an indication thereof to a means controlling operation of said electrical circuit; and, means positioning said sensor within said housing in a temperature sensing relationship with the water, said positioning means including a bracket fitting into an opening in an outer end of said housing, said bracket including an integrally formed tongue extending into said opening for an inner end of said tongue to be positioned adjacent said sidewall of said tank, and said sensor being encapsulated in said tongue at said inner end thereof.

10. The water heater of claim 9 wherein said sensor comprises a thermistor encapsulated in said tongue at said inner end thereof.

11. The water heater of claim 10 wherein said bracket is integrally formed with said housing.

12. The water heater of claim 10 wherein said screwplug has an opening formed therein and said sensor is positioned in said opening.

13. The water heater of claim 10 wherein said thermistor has electrical leads also encapsulated in said tongue with ends of said leads terminating in electrical connectors extending from said bracket for connecting said thermistor into said controlling means.

14. The water heater of claim 13 further including a second thermistor encapsulated in said tongue at the inner end thereof, said second thermistor also having electrical leads encapsulated in said tongue with ends of said leads terminating in electrical connectors extending from said bracket for connecting said second thermistor to said controlling means.

15. A water heater for heating water in a tank comprising:

a screwplug threadable into a threaded opening in a sidewall of said tank to mount the heater to the tank;

a heating element extending through said screwplug and into said tank to heat water in the tank;

a housing through which ends of said heater element extend for electrically connecting said heater element into an electrical circuit used for heating the water to a desired temperature and maintaining it at that temperature;

a thermistor installed in said housing for sensing the water temperature and providing an indication thereof to a means controlling operation of said electrical circuit; and, a bracket attaching to an outer end of said housing and including an integrally formed tongue extending into said opening for an inner end of said tongue to be positioned adjacent said sidewall of said tank, and said thermistor being encapsulated in said tongue at said inner end thereof.

16. The water heater of claim 15 wherein said bracket is integrally formed with said housing.

17. The water heater of claim 15 wherein an opening is formed in an outer end of said housing and said bracket has an outer end sized to fit into said opening for removably installing the thermistor in the housing.

* * * * *

UNITED STATES PATENT AND TRADEMARK OFFICE

CERTIFICATE OF CORRECTION

| | | |
|---|---|---|
| PATENT NO. | : | 6,069,998 |
| DATED | : | May 30, 2000 |
| INVENTOR(S) | : | Ronald R. Barnes, Robert K. Cockrell |

It is certified that error appears in the above-identified patent and that said Letters Patent is hereby corrected as shown below:

On the title page, [73] Assignee: please delete "Company" and insert therefore --Co.--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*